US006054654A

United States Patent [19]

Ebata

[11] Patent Number: 6,054,654

[45] Date of Patent: Apr. 25, 2000

[54] ROTARY SWITCH OR POTENTIOMETER WITH IMPROVED MOUNTED MOVABLE CONTACT

[75] Inventor: Junichi Ebata, Miyagi-ken, Japan

[73] Assignee: Alps Electric Co., Ltd., Tokyo, Japan

[21] Appl. No.: 09/161,934

[22] Filed: Sep. 28, 1998

[30] Foreign Application Priority Data

Oct. 3, 1997 [JP] Japan ..... 9-271584

[51] Int. Cl.[7] ..... H01H 19/02; H01H 21/02; H01C 1/12

[52] U.S. Cl. ..... 200/11 G; 200/275; 338/202

[58] Field of Search ..... 200/11 D, 11 DA, 200/11 G, 11 TW, 292; 338/202

[56] References Cited

U.S. PATENT DOCUMENTS

| | | | |
|---|---|---|---|
| 2,866,054 | 12/1958 | Purdy | 200/11 G |
| 4,131,771 | 12/1978 | Erickson et al. | 200/11 DA |
| 4,451,715 | 5/1984 | Neese | 200/11 G |
| 4,454,396 | 6/1984 | Neese | 200/292 |
| 4,625,084 | 11/1986 | Fowler et al. | 200/11 DA |
| 4,845,461 | 7/1989 | Hochholzer | 338/202 |
| 4,884,052 | 11/1989 | Eitoku et al. | 338/202 |
| 5,321,385 | 6/1994 | Rilling | 338/202 |

FOREIGN PATENT DOCUMENTS 2513352 7/1996 Japan .

*Primary Examiner*—J. R. Scott
*Attorney, Agent, or Firm*—Brinks Hofer Gilson & Lione

[57] ABSTRACT

A sliding element fixing structure for an electrical component comprising a sliding element formed of a metallic plate having tongues found in its base segment and a holding member to which the sliding element is fixed. The holding member has a flat surface and a bulged-out segment positioned and arranged below the flat surface. The base segment of the sliding element is mounted on the flat surface of the holding member with the end segments of the tongues engaging the lower part of the bulged-out segment which fixes the sliding element to the holding member.

4 Claims, 6 Drawing Sheets

ROTARY SWITCH OR POTENTIOMETER WITH IMPROVED MOUNTED MOVABLE CONTACT

BACKGROUND OF THE INVENTION

1. Field of the Invention

This invention relates to an electrical component such as a rotary switch for use with a variable resistor or the like, and more particularly to a structure for fixing of a sliding element to a holding member.

2. Description of the Related Art

The prior art electrical components as shown in FIGS. 7 to 11, are constructed such that a holding member 21 components, composed of a molded base section made of synthetic resin having a peripheral edge 21*a*, a flat upper surface 21*b*, an axial hole 21*c* arranged at a central part and a plurality of column-like segments 21*e*. The column-like segments 21*e* projected upwardly from the flat surface 21*b* and have a circular bulged-out segment 21*d* at their upper end part.

In addition, a sliding element 22 formed by a metallic plate is comprised of a flat base segment 22*a*. A sliding piece 22*b* is bent relative to the base segment 22*a* and extends from it. A plurality of holes 22*c* are arranged in the base segment 22*a* with a plurality of tongues 22*d* arranged in the holes 22*c*.

As shown in FIGS. 11A and 11B, fixing of the sliding element 22 to the holding member 21 is carried out such that the tongues 22*d* of the sliding element 22 are located above the bulged-out segment 21*d* of the holding member 21. When the base segment 22*a* of the sliding element 22 is pushed down, the tongues 22*d* are bent upwardly by the bulged-out segment 21*d*, and the ends of the tongues 22*d* ride over the bulged-out segment 21*d*, as shown in FIGS. 9 and 10. The extreme end portions of the tongues 22*d* remain bent upwardly and engage the lower part of the bulged-out segment 21*d*. As a result, the flat base segment 22*a* has been mounted on the flat surface 21*b* and the sliding element 22 is fixed to the holding member 21.

As described above, the holding member 21 having the sliding element 22 fixed thereto is rotatably attached to a shaft and the sliding piece 22*b* of the sliding element 22 can make sliding contact with a resistor or a contact point or the like. The sliding piece 22*b* is resiliently urged into contact with the resistor or the contact point or the like so as to perform an adjustment of a resistance value or a changing-over of contact point.

In addition, when the sliding element 22 is resiliently urged into contact with the resistor or the contact point or the like, as shown in FIG. 10, a force indicated by an arrow P1 is applied to the sliding piece 22*b*.

As illustrated in FIG. 10, the base segment 22*a* of the sliding element 22 exerts a force, in a direction of an arrow P2, applied by tongues 22*d* about a fulcrum point Y. The extremity ends of the tongues 22*d* are engaged with the column-like segment 21*e*, such that as the tongues 22*d* generate a push-back force. The base segment 22*a* is lifted up from the flat surface 21*a* at the base of the tongues 22*d*.

This lifting-up may generate not only an unstable contact to the sliding element 22 with the resistor or the contact point, but may also weaken the engagement state of the tongues 22*d* with the bulged-out segment 21*d*. This weakening is due to its repetition over a long period of time which results in a looseness in the fixing of the sliding element 22.

The prior art electrical component is constructed such that the holding member 21 is provided with the bulged-out segment 21*d* projected upwardly from the flat surface 21*b* and the tongues 22*d* of the sliding element 22 is engaged with the bulged-out segment 21*d* while being bent back upwardly. Thus, the prior art electrical component has a problem, in that when the base segment 22*a* of the tongues 22*d* is lifted up it causes an unstable contact of the sliding element 22.

Further, it may produce a problem that the engaged state of the tongues 22*d* with the bulged-out segment 21*d* is weakened due to a long term repetition of the lifted state and the fixed state of the sliding element 22 may become loose.

Further, a problem occurs in assembling the sliding element 22 and the holding member 21. In this assembly process, the tongues 22*d* must be located above the bulged-out segment 21*d* and, in this position, the sliding element 22 cannot rest on the flat surface 21*b* of the holding member 21. Thus, the sliding element 22 must be moveably supported during assembly. As a result, assembly of the prior art bracket is troublesome and expensive, and can result in an inferior product.

SUMMARY OF THE INVENTION

As a first step for solving the aforesaid problems, there is provided a sliding element fixing structure formed of a metallic plate having tongues at the base segment, and a holding member to which the sliding element is fixed. The holding member has a flat, upper surface and a bulged-out segment positioned and arranged below the flat surface. As a result, the base segment of the sliding element can rest on the flat surface of the holding member, while end segments of the tongues are engaged with the lower part of the bulged-out segment and the sliding element is thus fixed to the holding member.

In addition, as a second step, the bulged-out segment has a conical shape.

Further, as a third step, the sliding element is formed with a pair of tongues that are opposite to each other so as to hold the bulged-out segment therebetween and a pair of position setting protrusions between the tongues.

DESCRIPTION OF THE PREFERRED EMBODIMENT

As shown in FIGS. 1 to 6, the electrical component of the present invention is constructed such that a holding member 1 acting as a rotary member composed of a molded product made of synthetic resin comprises a supporting base segment 1*b* having a flat surface 1*a*. An axial hole 1*c* arranged at the center of member 1. A plurality of indentations 1*d* are indented in a downward direction into the flat surface 1*a*. A column-like segment 1*e* is provided in each of the indentations 1*d* that has a conical shaped bulged-out segment 1*f* near its upper end. The bulged-out segment 1*f* is positioned below the flat surface 1*a*. A protrusion 1*g*, having a circular cross-section, is arranged at the upper end of the bulged-out segment 1*f* and projects upwardly from the flat surface 1*a*.

Figure 1:
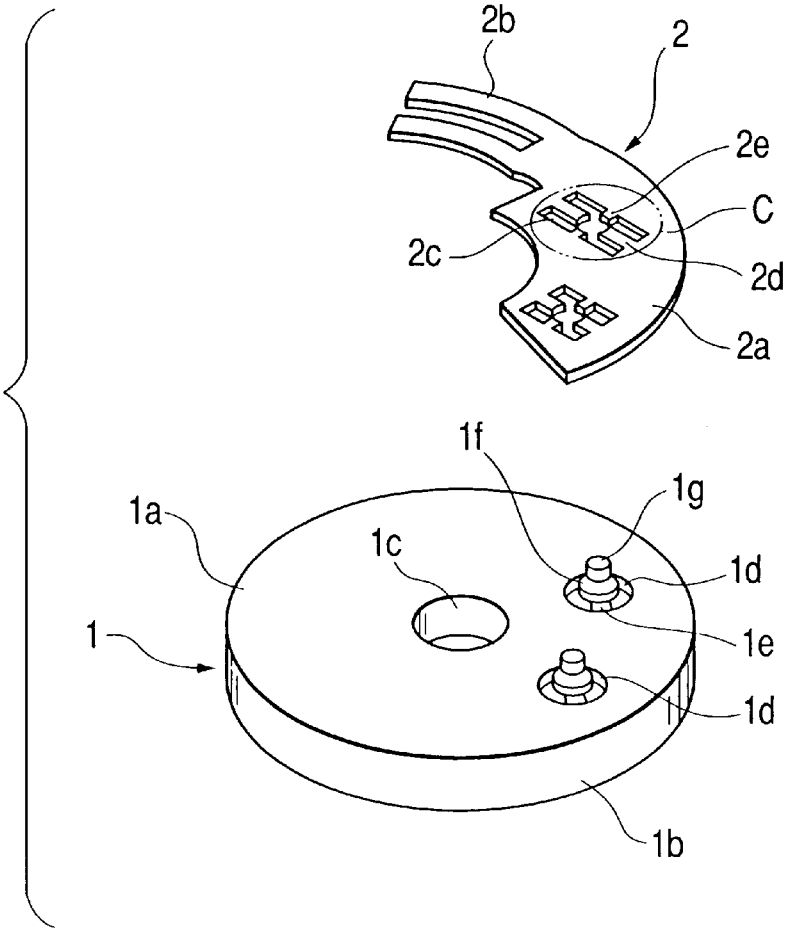
FIG. 1 is an exploded perspective view showing a holding member and a sliding element in an electrical component of the present invention.
Figure 2:
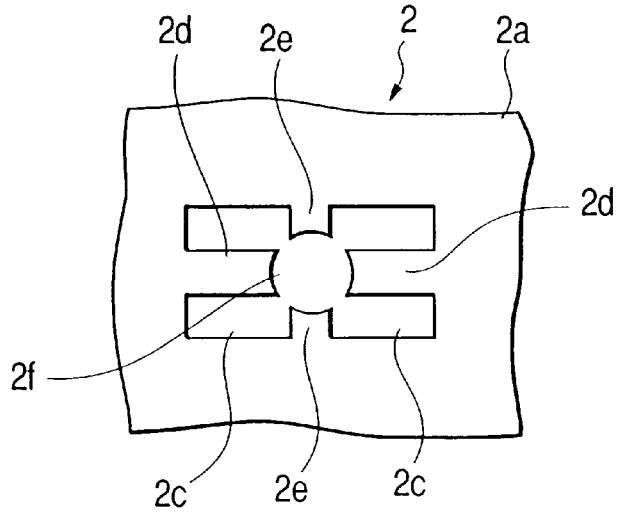
FIG. 2 is an enlarged top plan view showing part C in FIG. 1.

The sliding element, that is formed of a metallic plate, is comprised of a flat base segment 2*a* and a sliding piece 2*b* bent back from the base segment 2*a* and extending from it. A plurality of holes 2*c* are arranged in the base segment 2*a*. As is best seen in FIG. 2, a pair of opposing tongues 2*d* are arranged in the holes 2*c*, as well as a pair of position setting protrusions 2*e* that are opposite to each other and between the tongues 2*d*. A circular clearance 2*f* is formed at the free ends of tongues 2*d* and protrusions 2*e*.

Figure 6A:
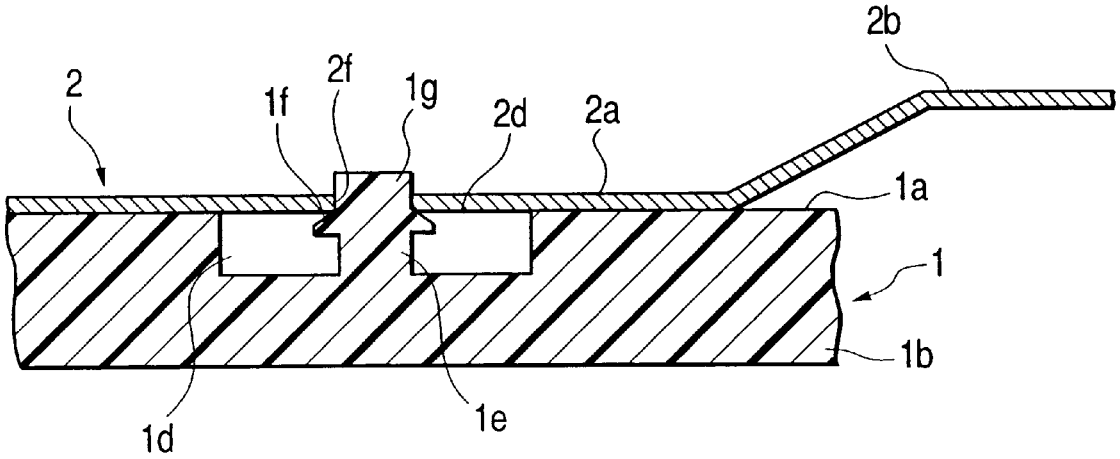
FIGS. 6A and 6B are illustrative views of a step in the assembling operation of the holding member and the sliding element in an electrical component of the present invention.
Figure 6B:
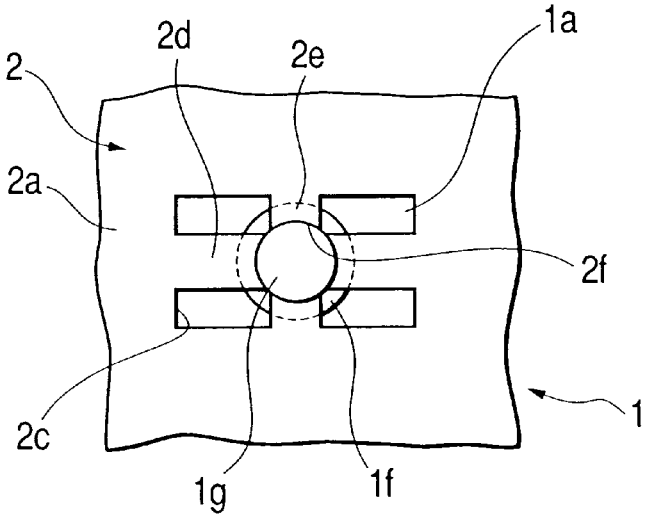
Figure 7:
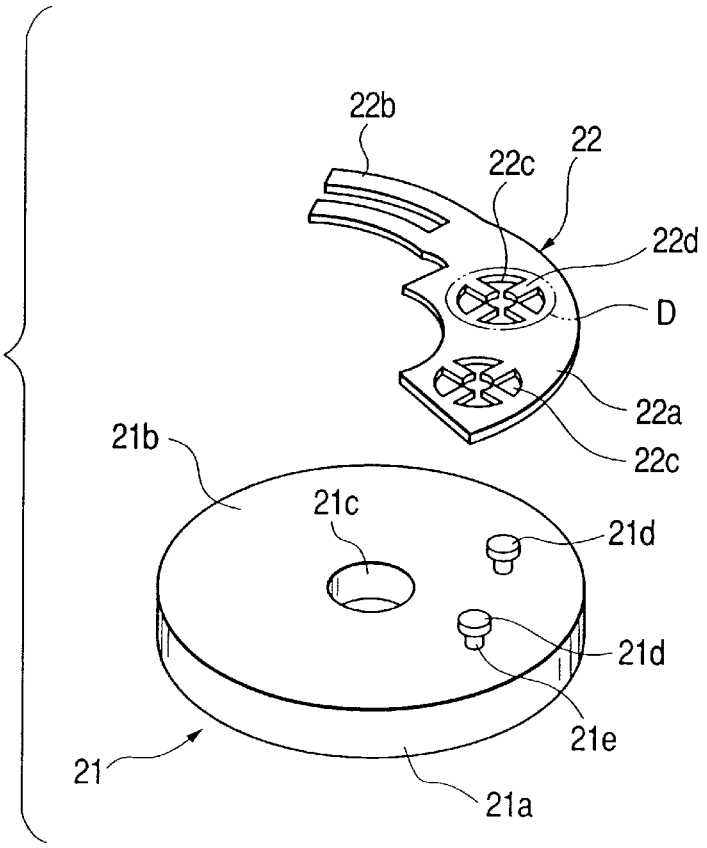
FIG. 7 PRIOR ART
FIG. 7 is an exploded perspective view showing the holding member and the sliding element of a prior art electrical component.
Figure 8:
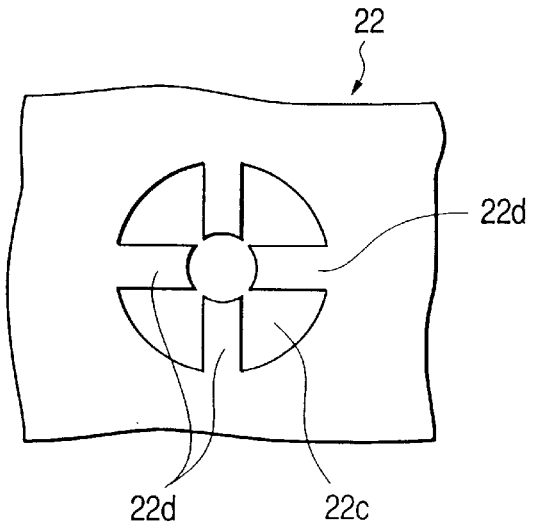
FIG. 8 PRIOR ART
FIG. 8 is an enlarged top plan view showing part D in FIG. 7.
Figure 9:
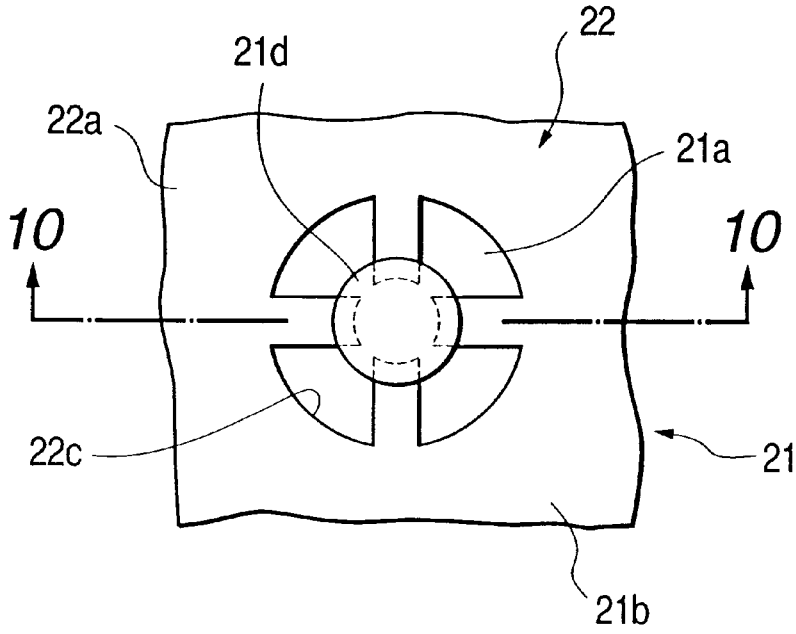
FIG. 9 PRIOR ART
FIG. 9 is an enlarged top plan view showing a substantial part in the prior art electrical component.
Figure 10:
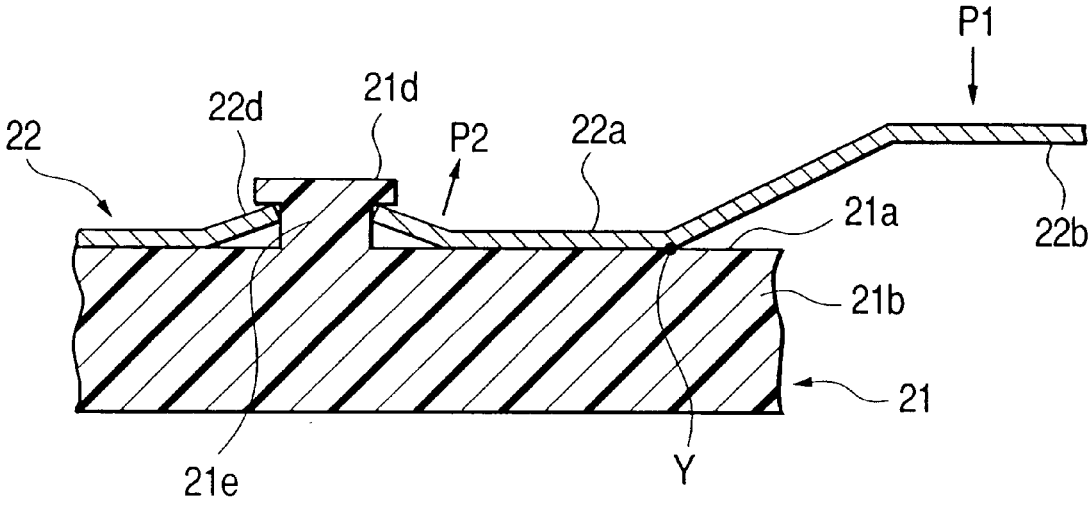
FIG. 10 PRIOR ART
FIG. 10 is an enlarged sectional view taken along line 10—10 in FIG. 9.
Figure 11A:
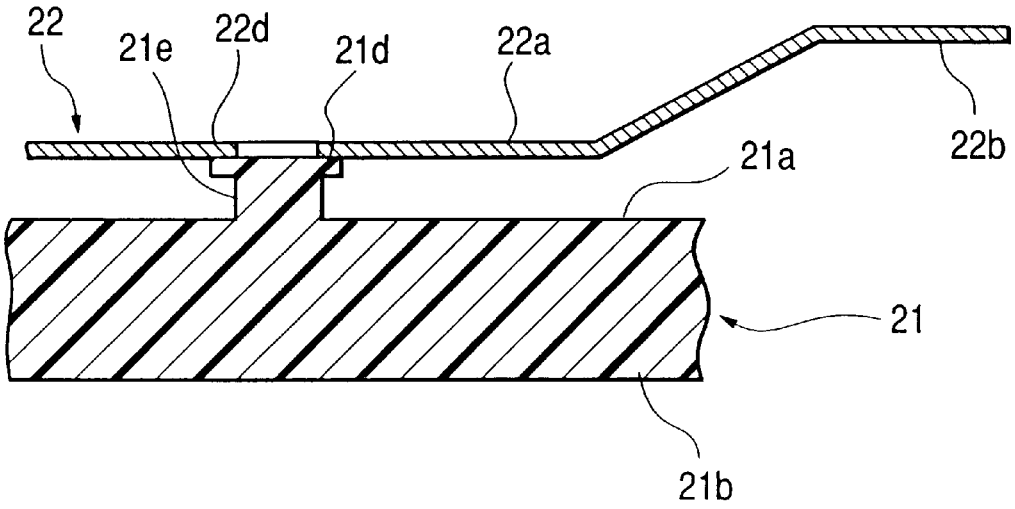
FIG. 11A PRIOR ART
FIGS. 11A and 11B are illustrative views of a step in the assembling operation of the holding member and the sliding element in the prior art electrical component.
Figure 11B:
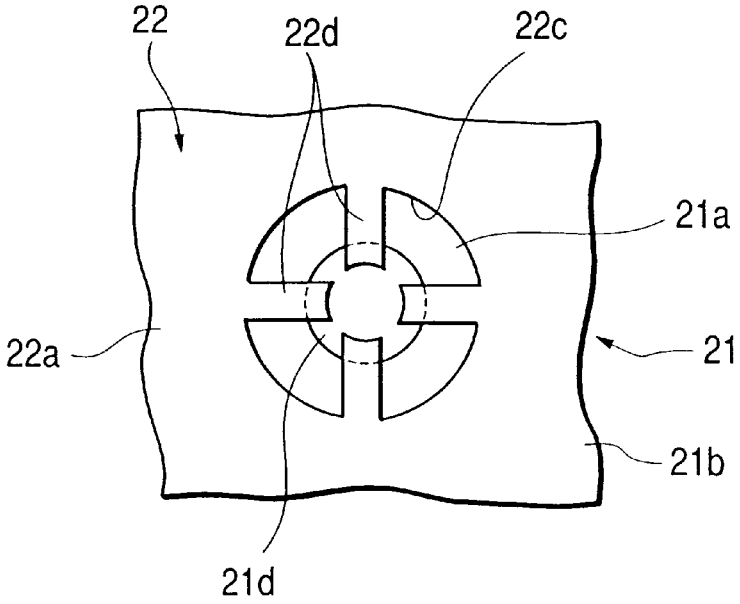
FIG. 11B PRIOR ART

As shown in FIGS. 6A and 6B, assembly of the sliding element 2 to the holding member 1 is carried out such that the protrusion 1*g* on the bulged-out segment 1*f* of the holding member 1 is inserted into the clearance 2*f* formed at the ends of the tongues 2*d* and the protrusions 2*e* of the sliding element. This permits the base segment 2*a* of the sliding element 2 to lay flat on the flat surface 1*a* of the holding member 1.

At this time, the extremity ends of the tongues 2*d* and the protrusions 2*e* are located at opposing positions while the protrusion 1*g* is being held therebetween. As a result of there being a plurality of column-like segments 1*g* and holes 2*c*, this assembly step serves as a position setting of the sliding element 2 with respect to the protrusion 1*g*.

Figure 3:
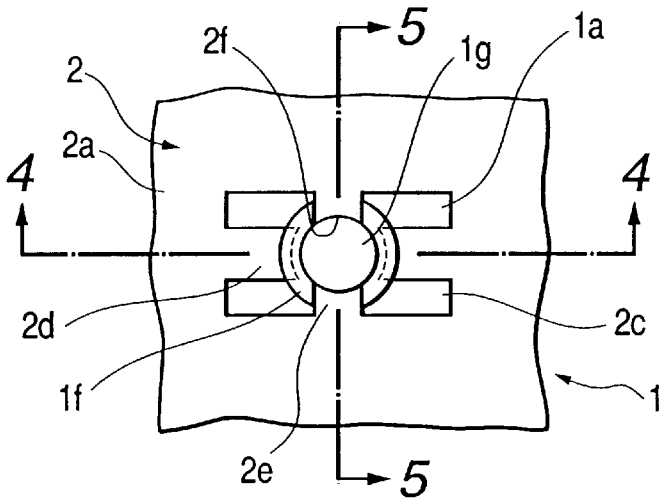
FIG. 3 is an enlarged to plan view showing a substantial part of an electrical component of the present invention.
Figure 4:
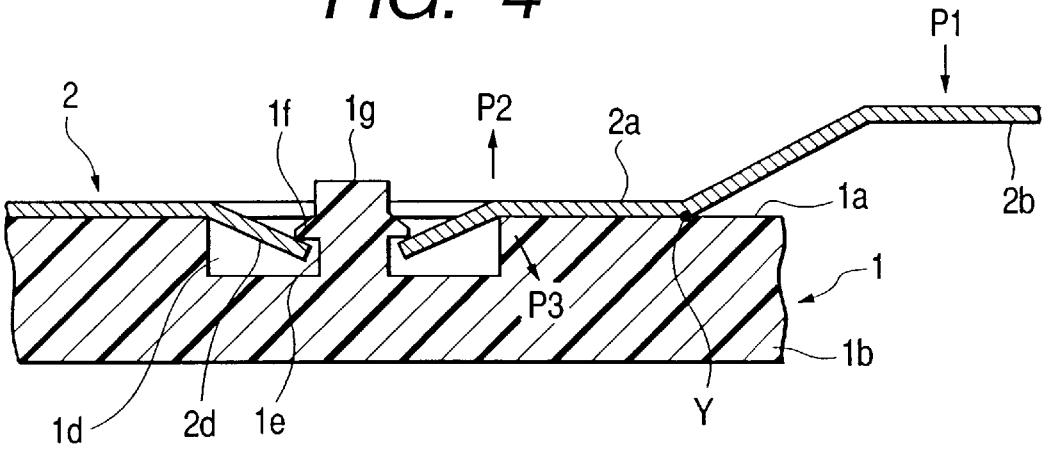
FIG. 4 is an enlarged sectional view taken along line 4—4 of FIG. 3.
Figure 5:
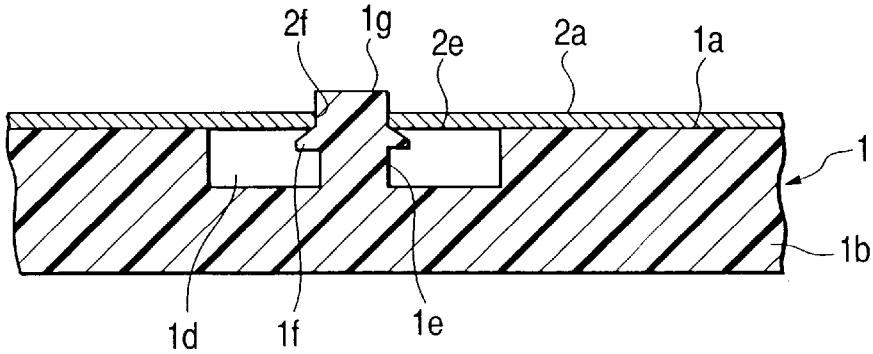
FIG. 5 is an enlarged sectional view taken along line 5—5 of FIG. 3.

In the next step of the assembly process, the pair of tongues 2*d* of the sliding element 2 are pushed down by a jig (not shown). The tongues 2*d* are flexed downwardly against their spring resiliency and as the extremity ends of the tongues 2*d* exceed the bulged-out segment 1*f*, they engage the lower part of the bulged-out segment 1*f* as shown in FIGS. 3 and 4. The flat base segment 2*a* engages the flat surface 1*a* and the sliding element 2 is now fixed to the holding member 1.

The protrusions 2*e* of the sliding element 2 maintain their position against the outer circumferential part of the protrusion 1*g* and, thus, define the position of the sliding element 2.

The holding member 1 having the sliding element 2 fixed thereto is rotatably attached to a shaft (not shown). Rotation of this shaft causes the sliding piece 2*b* of the sliding element 2 to slidably contact a resistor or a contact point or the like. This contact causes a resistance value to be adjusted or a contact point to be changed over.

In this situation, when the sliding element 2 is in resilient contact with the resistor or the contact point or the like, a force in a direction of arrow P1 is applied to the sliding piece 2*b* as shown in FIG. 4.

Although a force in a direction of arrow P2 is applied to the tongues 2*d* applied about a fulcrum point Y at the base segment 2*a* of the sliding element 2, the tongues 2*d* are pushed downwardly. The tongues 2*d* are always resiliently pressed in a direction of arrow P3 (downwardly) and as a result, the base segment 2*a* is not lifted up from the flat surface 1*a*.

Additionally, the tongues 2*d* in the preferred embodiment described above may be arranged at the outer circumferential edge of the sliding element 2. The position setting protrusions 2*e* may be set in position by a part of an outer shape of the sliding element 2. Also, the holding member 1 may function at the fixed part and thus not rotated.

In addition, for the sake of convenience in machining the bulged-out segment 1*f*, they may be formed only at a position where the tongues 2*d* are abutted against the bulged-out segment. The tongues 2*d* may pass through the lower part of the partial formed bulged-out segment 1*f* in which the remaining portions may be eliminated.

In accordance with this invention, the electrical component of the present invention provides an electrical component in which the holding member 1 is provided with the bulged-out segment 1*f* below the flat surface 1*a*. The base segment 2*a* of the sliding element 2 is mounted on the flat surface 1*a*, the end segments of the tongues 2*d* of the sliding element 2 are engaged with the lower part of the bulged-out segment 1*f* and the sliding element 2 is thereby fixed to the holding member 1. As a result of this structure, even if a pressing force is applied to the sliding piece 2*b* of the sliding element 2, the root segments of the tongues 2*d* at the base segment 2*a* is not lifted up from the flat surface 1*a* and a stable contacted state is retained.

Additionally, since the roots of the tongues 2*d* at the base segment 2*a* are not lifted up, the likelihood of a fatigue failure of the tongues 2*d* is diminished as compared to that of the prior art. Thus, as a result of this invention, an electrical component in which the sliding element 2 can be positively fixed for a long period of time has been provided.

Further, since the bulged-out segment 1*f* is formed below the flat surface 1*a*, a sliding element can be assembled with the base segment 2*a* mounted on the flat surface 1*a*. Accordingly, supporting the sliding element 2 becomes simple and it is possible to provide a less-expensive electrical component having a superior productivity.

Additionally, since there is provided a conical-shaped bulged-out segment 1*f*, it is possible to provide an electrical component having a superior assembling characteristic in which the tongues 2*d* are easily fixed during assembling operation.

In addition, since the sliding element 2 is provided with a pair of opposing tongues 2*d* and a pair of position setting protrusions 2*e* arranged between the tongues 2*d* and opposite to each other, it is possible to provide a small-sized electrical component in which the engagement of the sliding element 2 with the bulged-out segment 1*f* can be positively performed. Also, a position setting by the protrusions 2*e* with the protrusion 1*g* can be attained. The position setting of the sliding element 2 with respect to the holding member 1 can be performed easily and positively, and a position setting in a small space can be attained.

What is claimed is:

1. An electrical component for adjusting a resistance value or changing over a contact point comprising:

a sliding element having a sliding piece formed of a metallic plate, said sliding piece adapted to slidably contact a resistor or a contact point for the purpose of adjusting a resistance value or changeing over a contact point, said sliding element further including a flat base segment connected to said sliding piece having tongues forming a recess hole in said base segment; and a rotatable or reciprocatable sliding element holding member having a flat surface and a clearance formed in said flat surface, said holding member further having a bulged-out segment arranged in said clearance below said flat surface, said bulged-out segment including an engaging surface to be engaged by said tongues; wherein said flat base segment of said sliding element is mounted on the flat surface of said holding member, the free end parts of said tongues are pushed down against the spring resistance of the tongues and engaged with said engaging surface of said bulged-out segment resulting in said sliding element being fixed to said holding member.

2. The electrical component for adjusting a resistance value or changing over a contact point according to claim 1, wherein said bulged-out segment is formed in a conical shape and formed in such a way that said engaging surface forms the bottom surface of said cone.

3. The electrical component for adjusting a resistance value or changing-over a contact point according to claim 1, wherein said sliding element is formed with a pair of tongues opposing each other with said bulged-out segment being held therebetween, and a pair of opposed positioning protrusions formed between said pair of tongues to be connected to said bulged-out segment.

4. The electrical component for adjusting a resistance value or changing-over a contact point according to claim 1, wherein there are provided a plurality of sets of sliding elements and sliding element holding members comprised of said tongues and said bulged-out segment.

* * * * *